US010048637B2

(12) United States Patent
Morishita et al.

(10) Patent No.: US 10,048,637 B2
(45) Date of Patent: Aug. 14, 2018

(54) IMAGE CARRYING MEMBER UNIT AND IMAGE FORMING APPARATUS THEREWITH

(71) Applicant: KYOCERA Document Solutions Inc., Osaka (JP)

(72) Inventors: Hiroki Morishita, Osaka (JP); Susumu Hanano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/580,145

(22) PCT Filed: Aug. 24, 2016

(86) PCT No.: PCT/JP2016/074587

§ 371 (c)(1),
(2) Date: Dec. 6, 2017

(87) PCT Pub. No.: WO2017/081905

PCT Pub. Date: May 18, 2017

(65) Prior Publication Data

US 2018/0136600 A1 May 17, 2018

(30) Foreign Application Priority Data

Nov. 9, 2015 (JP) ..... 2015-219272

(51) Int. Cl.
*G03G 15/00* (2006.01)

(52) U.S. Cl.
CPC ..... *G03G 15/751* (2013.01)

(58) Field of Classification Search
USPC ..... 399/107, 110, 111, 116, 117
See application file for complete search history.

(56) References Cited

U.S. PATENT DOCUMENTS 5,130,751 A * 7/1992 Sato ..... G03G 15/751 399/117
6,311,026 B1 * 10/2001 Higeta ..... G03G 21/1853 399/111

(Continued)

FOREIGN PATENT DOCUMENTS

JP 2003-323016 A 11/2003
JP 2006-251421 A 9/2006

*Primary Examiner* — Hoan Tran
(74) *Attorney, Agent, or Firm* — Stein IP, LLC

(57) ABSTRACT

An image carrying member unit is provided with an image carrying member, and a unit housing. The image carrying member includes an image carrying member main body which has an outer peripheral surface on which a photosensitive layer is formed, a flange part which is secured to both ends of the image carrying member main body, a cylindrical oil-impregnated sintered bearing which is secured to the through-hole of the flange part, a conduction member which conducts electricity between the oil-impregnated sintered bearing and the image carrying member main body, a spindle which is slidably inserted in the oil-impregnated sintered bearing and secured to the unit housing, and a contact spring which has a coiled spring part into which the spindle is inserted, and which is sandwiched in a compressed state between an end surface in the axial direction of the oil-impregnated sintered bearing and the unit housing.

5 Claims, 5 Drawing Sheets

(56) References Cited

U.S. PATENT DOCUMENTS 8,682,199 B2 * 3/2014 Toyoda ..... G03G 15/751
361/214
8,712,277 B2 * 4/2014 Ooyoshi ..... G03G 15/751
399/90

* cited by examiner

IMAGE CARRYING MEMBER UNIT AND IMAGE FORMING APPARATUS THEREWITH

CROSS-REFERENCE TO RELATED APPLICATIONS

This application is a national stage of International Application No. PCT/JP2016/074587, filed Aug. 24, 2016, which claims the benefit of priority to Japanese Application No. 2015-219272, filed Nov. 9, 2015, in the Japanese Patent Office, the disclosures of which are incorporated herein in their entireties by reference.

TECHNICAL FIELD

The present invention relates to an image forming apparatus such as a copier, a printer, or a facsimile machine. More particularly, the present invention relates to an image carrying member unit that carries an electrostatic latent image, and to an image forming apparatus incorporating such an image carrying member unit.

BACKGROUND ART

In conventional image forming apparatuses adopting an electrophotographic process, an electrostatic latent image is formed on a photosensitive drum (image carrying member) having been electrostatically charged uniformly, and the electrostatic latent image is developed into a toner image to form an image on a sheet (recording medium).

The photosensitive drum is provided with sintered bearings in opposite end parts of it. When the photosensitive drum is fitted to a unit case, the sintered bearings each make contact with an electrode chip provided on the unit case. The electrode chip is formed of a sintered member, and is connected to the main body of an image forming apparatus via a ground lead or the like. This permits conduction to the ground (earthing) of slight electric charge remaining on the photosensitive drum after toner image transfer.

For example, Patent Document 1 discloses a drum holding structure that includes an electrode chip which is in sliding contact with a sintered copper portion arranged in an end part of a photosensitive drum and which is formed of a sintered copper member to make the photosensitive drum electrically conductive, an accommodation recess formed in a holder to accommodate the electrode chip, a spring which elastically biases the electrode chip to keep it in contact with the sintered copper portion, and a stopper which keeps the protruding amount of the electrode chip from the accommodation recess at a predetermined amount.

Patent Document 2 discloses a configuration in which core bars of two brush rollers for scraping off toner remaining on the surface of an image carrying member are short-circuited with each other via two sintered bearings which support the two core bars respectively and a flat spring which makes contact with the sintered bearings. A method is also known in which the configuration of Patent Document 2 is applied to a photosensitive drum to keep a sintered bearing fitted to a flange portion of the photosensitive drum and the photosensitive drum pipe in contact with each other via the flat spring and to keep the sintered bearing and the drum shaft in sliding contact with each other so that mutual electrical conduction between the photosensitive drum and the drum shaft is secured.

LIST OF CITATIONS

Patent Literature

Patent Document 1: JP-A-2003-323016
Patent Document 2: JP-A-2006-251421

SUMMARY OF THE INVENTION

Technical Problem

A sintered bearing as mentioned above is typically impregnated with oil to ensure lubricity. However, oil exudes on the sliding plane of the sintered bearing, and thereby forms an electrically insulating oil film; this inconveniently blocks electrical conduction. The conductive resistance may inconveniently vary with the amount of oil impregnated in the sintered bearing and the load applied to the bearing. The variation in electrical conduction of the photosensitive drum inconveniently results in non-uniform electrical charge remaining on the surface of the photosensitive drum, leading to image unevenness.

Devised against the background discussed above, an object of the present invention is to provide an image carrying member unit that can secure stable electrical conduction between an oil-impregnated sintered bearing, which is interposed between an image carrying member main body and a support shaft, and the support shaft, and to provide an image forming apparatus incorporating such an image carrying member unit.

Means for Solving the Problem

To achieve the above object, according to a first aspect of the present invention, an image carrying member unit includes an image carrying member and a unit housing. On the image carrying member, an electrostatic latent image is formed. The unit housing holds the image carrying member. The image carrying member includes an image carrying member main body, flange portions, an oil-impregnated sintered bearing, a conductive member, a support shaft, and a contact spring. The image carrying member main body has a photosensitive layer formed on its circumferential surface. The flange portions are fixed to opposite end parts of the image carrying member main body. The flange portions each have formed therein a through hole at the center of rotation of the image carrying member main body. The oil-impregnated sintered bearing is in a cylindrical shape and is fixed in the through hole in each of the flange portions. The conductive member permits electrical conduction between the oil-impregnated sintered bearing and the image carrying member main body. The support shaft is slidably inserted into the oil-impregnated sintered bearing to be fixed to the unit housing. The contact spring has a helical spring portion into which the support shaft is inserted. The contact spring permits mutual electrical conduction between the oil-impregnated sintered bearing and the support shaft by being held in a compressed state between an end surface of the oil-impregnated sintered bearing in the axial direction and the unit housing.

Advantageous Effects of the Invention

According to the first aspect of the present invention, the support shaft and the oil-impregnated sintered bearing are electrically connected via the contact spring, and thus their contact pressure is stabilized by the biasing force of the contact spring. As a result, the conductive resistance value at a place where the oil-impregnated sintered bearing and the contact spring make contact with each other is stabilized at a low value. Although, on the sliding plane (inner circumferential surface) of the oil-impregnated sintered bearing, an oil film is formed, the contact spring makes contact with an end surface of the oil-impregnated sintered bearing in the axial direction, and thus can keep stable electrical conduction without being affected by the oil film. Thus, it is possible to effectively suppress image unevenness resulting from electric charge remaining on the surface of the image carrying member.

DESCRIPTION OF EMBODIMENTS

Figure 1:
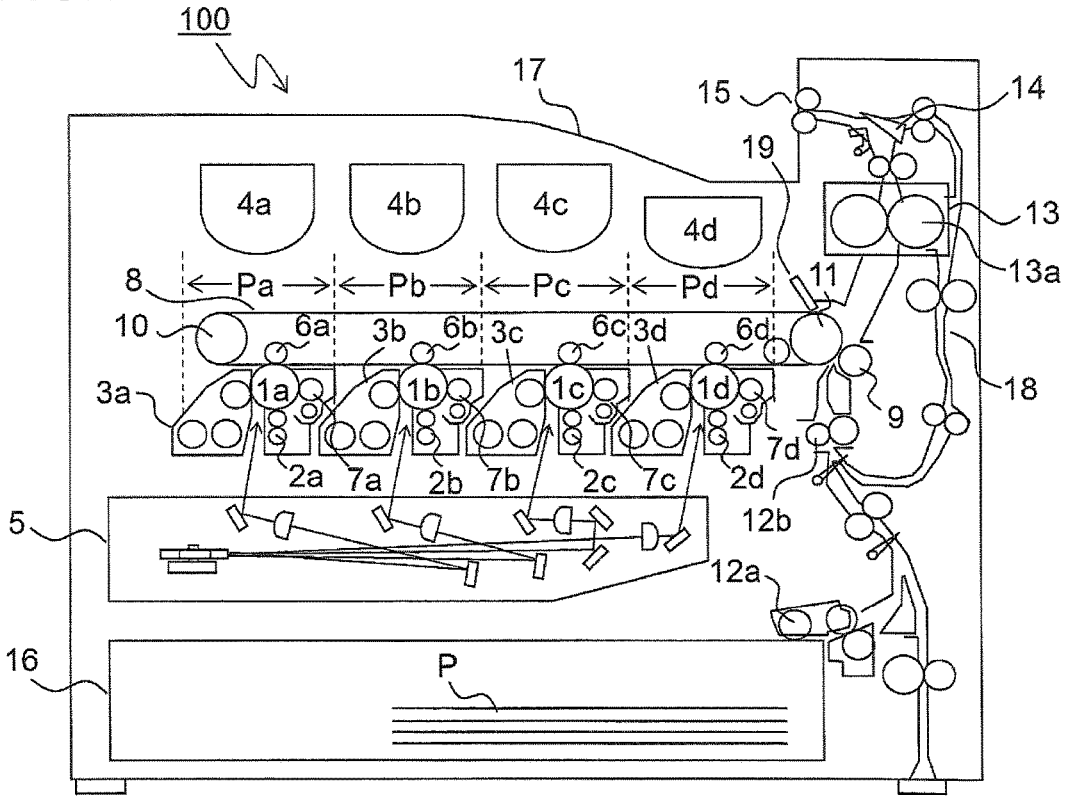
FIG. 1 is a schematic sectional view showing an internal structure of an image forming apparatus 100 according to one embodiment of the present invention.

Hereinafter, an embodiment of the present invention will be described with reference to the accompanying drawings. FIG. 1 is a sectional view showing an outline of the structure of an image forming apparatus 100 according to one embodiment of the present invention, here showing a tandem-type color printer. In the main body of the image forming apparatus 100, four image forming portions Pa, Pb, Pc, and Pd are arranged in this order from the upstream side (the left side in FIG. 1) in the conveyance direction. These image forming portions Pa to Pd are provided to correspond to images of four different colors (cyan, magenta, yellow, and black) respectively, and sequentially form cyan, magenta, yellow, and black images respectively, each through the processes of electrostatic charging, exposure to light, image development, and image transfer.

In these image forming portions Pa to Pd, there are respectively arranged photosensitive drums 1*a* to 1*d* that carry visible images (toner images) of the different colors. Moreover, an intermediate transfer belt 8 that rotates in the counter-clockwise direction in FIG. 1 is arranged next to the image forming portions Pa to Pd.

When image data is fed in from a host device such as a personal computer, first, by charging devices 2*a* to 2*d*, the surfaces of the photosensitive drums 1*a* to 1*d* are electrostatically charged uniformly. Then, by an exposing unit 5, the surfaces of the photosensitive drums 1*a* to 1*d* are irradiated with light based on the image data, and thereby electrostatic latent images based on the image data are formed on the photosensitive drums 1*a* to 1*d*. Developing devices 3*a* to 3*d* are charged with predetermined amounts of two-component developer (hereinafter, also referred to simply as developer) containing toner of different colors, namely cyan, magenta, yellow, and black from toner containers 4*a* to 4*d* respectively. The toner in the developer is fed from the developing devices 3*a* to 3*d* onto the photosensitive drum la to 1*d*, and electrostatically attaches to them. Thereby, toner images based on the electrostatic latent images formed by exposure to light from the exposing unit 5 are formed.

Then, an electric field is applied, by primary transfer rollers 6*a* to 6*d*, between the primary transfer rollers 6*a* to 6*d* and the photosensitive drums 1*a* to 1*d* with a predetermined transfer voltage, and the cyan, magenta, yellow, and black toner images on the photosensitive drums 1*a* to 1*d* are primarily transferred to the intermediate transfer belt 8. Toner and the like that remain attached to the surfaces of the photosensitive drums 1*a* to 1*d* after primary transfer are removed by cleaning devices 7*a* to 7*d*.

Sheets P to which toner images are to be transferred are stored in a sheet cassette 16 arranged in a lower part of the image forming apparatus 100. A sheet P is conveyed, via a sheet feeding roller 12*a* and a registration roller pair 12*b*, with predetermined timing, to a nip (secondary transfer nip) between a secondary transfer roller 9 arranged next to the intermediate transfer belt 8 and the intermediate transfer belt 8. The sheet P having the toner images transferred to it is conveyed to a fixing device 13.

The sheet P conveyed to the fixing device 13 is then heated and pressed there by a fixing roller pair 13*a* so that the toner images are fixed to the surface of the sheet P to form a predetermined full-color image. The sheet P having the full color image formed on it is discharged, as it is (or after being distributed by a branching portion 14 into a reverse conveyance passage 18 and having images formed on both sides of it), onto a discharge tray 17 by a discharge roller pair 15.

Figure 2:
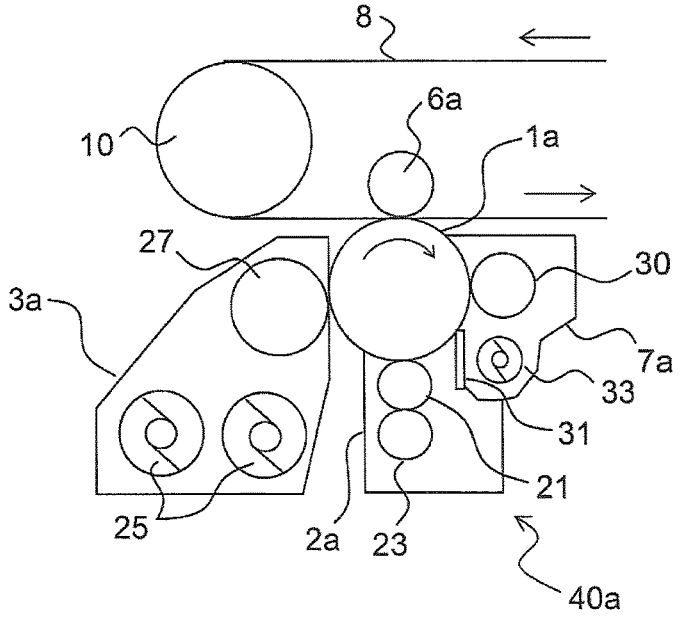
FIG. 2 is an enlarged sectional view around the image forming portion Pa in FIG. 1.

Now, the above-described image forming portion Pa will be described in detail. The image forming portions Pb to Pd have basically the same structure as the image forming portion Pa, and thus no overlapping description will be repeated. FIG. 2 is an enlarged sectional view around the image forming portion Pa in FIG. 1. Around the photosensitive drum 1*a* are arranged, along the rotation direction of the photosensitive drum 1*a* (the clockwise direction in FIG. 2), the charging device 2*a*, the developing device 3*a*, the primary transfer roller 6*a*, and the cleaning device 7*a*, of which all have been already mentioned. Of these components, the primary transfer roller 6*a* is arranged opposite the photosensitive drum 1*a* across the intermediate transfer belt 8.

The photosensitive drum 1*a*, the charging device 2*a*, and the cleaning device 7*a* are integrated into a unit. In the image forming portions Pa to Pd, units composed of the photosensitive drums 1*a* to 1*d*, the charging devices 2*a* to 2*d*, and the cleaning devices 7*a* to 7*d* are hereinafter referred to as drum units 40*a* to 40*d* respectively.

The charging device 2*a* includes a charging roller 21 which applies a charging bias to the surface of the photosensitive drum 1*a* while in contact with it, and a charge cleaning roller 23 for cleaning the charging roller 21. The developing device 3*a* includes two stirring/conveying members 25 composed of a stirring/conveying screw and a feeding/conveying screw, and a magnetic roller 27. The developing device 3*a* brings the two-component developer (magnetic brush) carried on the surface of the magnetic roller 27 into contact with the surface of the photosensitive drum 1*a* to develop an electrostatic latent image into a toner image.

The cleaning device 7*a* includes a rubbing roller 30, a cleaning blade 31, and a collection spiral 33. The rubbing roller 30 is in pressed contact with the photosensitive drum 1*a* under a predetermined pressure, and is driven to rotate by a drum cleaning motor (unillustrated) in the same direction as the photosensitive drum 1*a* at the plane of the contact with it. The linear velocity of the rubbing roller 30 is controlled to be higher (here 1.2 times higher) than the linear velocity of the photosensitive drum 1*a*.

On the surface of the photosensitive drum 1*a*, on the downstream side of the plane of contact with the rubbing roller 30 in the rotation direction, the cleaning blade 31 is fixed in contact with the photosensitive drum 1*a*. The material, hardness, and dimensions of the cleaning blade 31, the depth and pressing force with which the cleaning blade 31 is pressed onto the photosensitive drum 1*a*, etc. can be set as necessary according to the specifications of the photosensitive drum 1*a*.

The unused toner removed from the surface of the photosensitive drum 1*a* by the rubbing roller 30 and the cleaning blade 31 is, as the collection spiral 33 rotates, discharged out of the cleaning device 7*a*.

Figure 3:
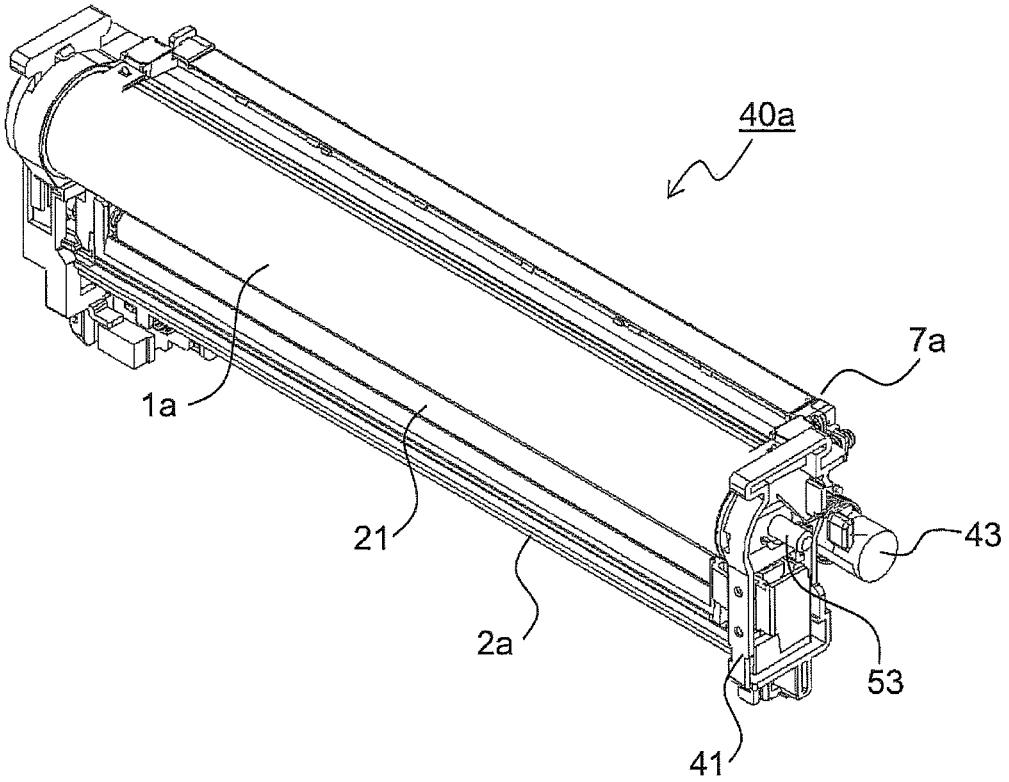
FIG. 3 is an exterior perspective view of a drum unit 40*a* mounted in the image forming apparatus 100.

FIG. 3 is an exterior perspective view of the drum unit 40*a* as seen from the upstream side in its inserting direction with respect to the image forming apparatus 100. The drum units 40*b* to 40*d* have basically the same structure as the drum unit 40*a*, and thus no overlapping description will be repeated. As shown in FIG. 3, the drum unit 40*a* has a unit housing 41 which holds the photosensitive drum 1*a*, the charging device 2*a*, and the cleaning device 7*a*. From one end (the front right side in FIG. 3) of the drum unit 40*a*, a drum shaft 53 of the photosensitive drum 1*a* protrudes.

From one end (the front right side in FIG. 3) of the drum unit 40*a*, also a toner discharge portion 43 of the cleaning device 7*a* protrudes. Waste toner collected from the surface of the photosensitive drum 1*a* by the cleaning device 7*a* is discharged through the toner discharge portion 43 by the rotation of the collection spiral 33 (see FIG. 2), and is conveyed to a developer collection container (unillustrated).

Figure 4:
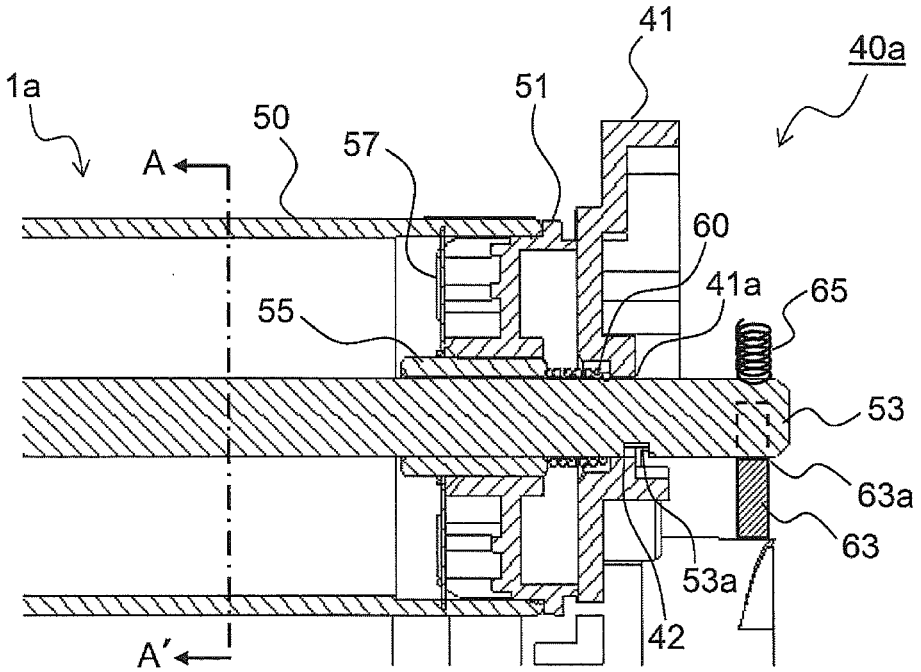
FIG. 4 is a side sectional view of one end of the drum unit 40*a* as cut along a drum shaft 53.
Figure 5:
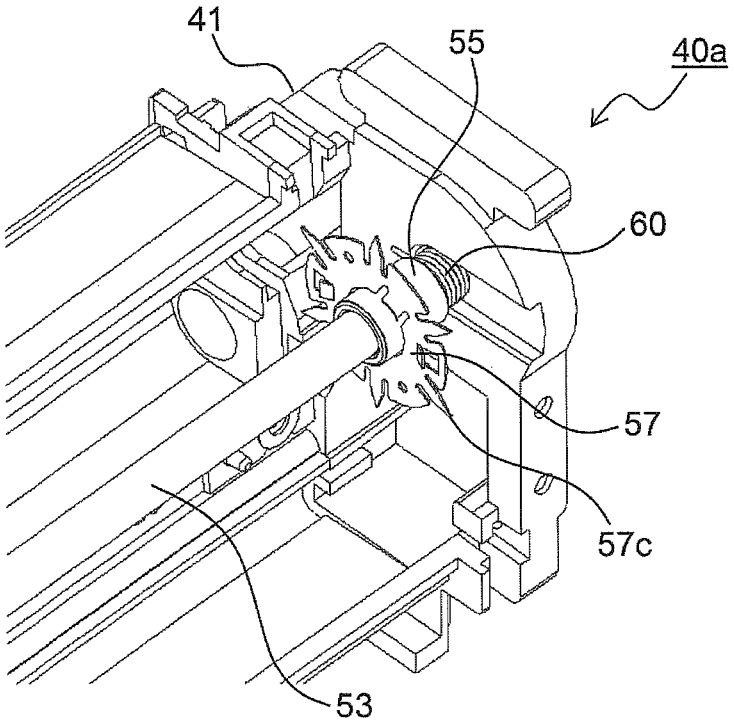
FIG. 5 is an enlarged perspective view of one end of the drum unit 40*a;*
Figure 6:
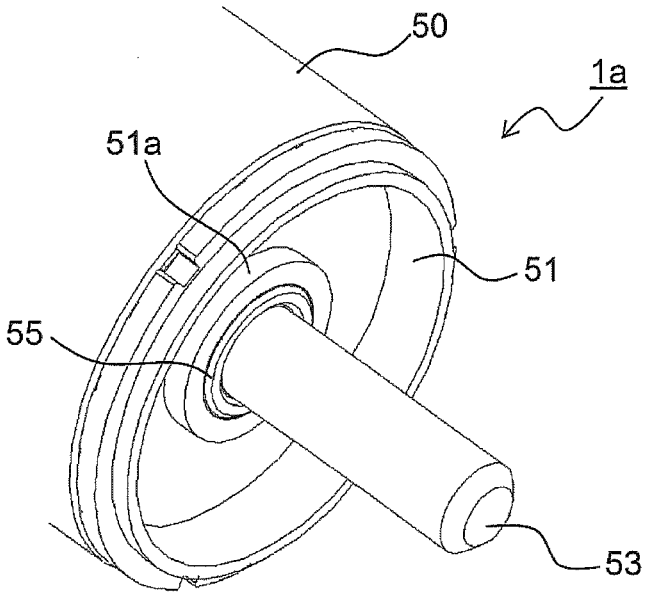
FIG. 6 is a partial perspective view of one end of a photosensitive drum 1*a;*
Figure 7:
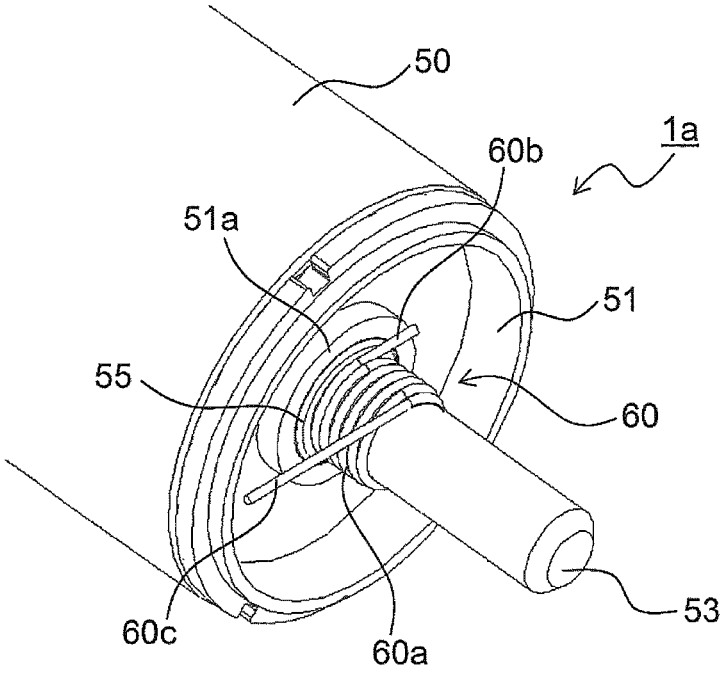
FIG. 7 is a partial perspective view of one end of the photosensitive drum 1*a* having a contact spring 60 fitted to the drum shaft 53.
Figure 8:
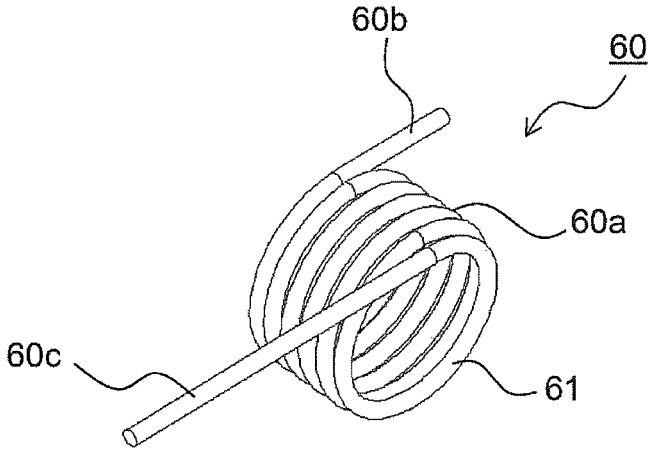
FIG. 8 is a perspective view of the contact spring 60.
Figure 9:
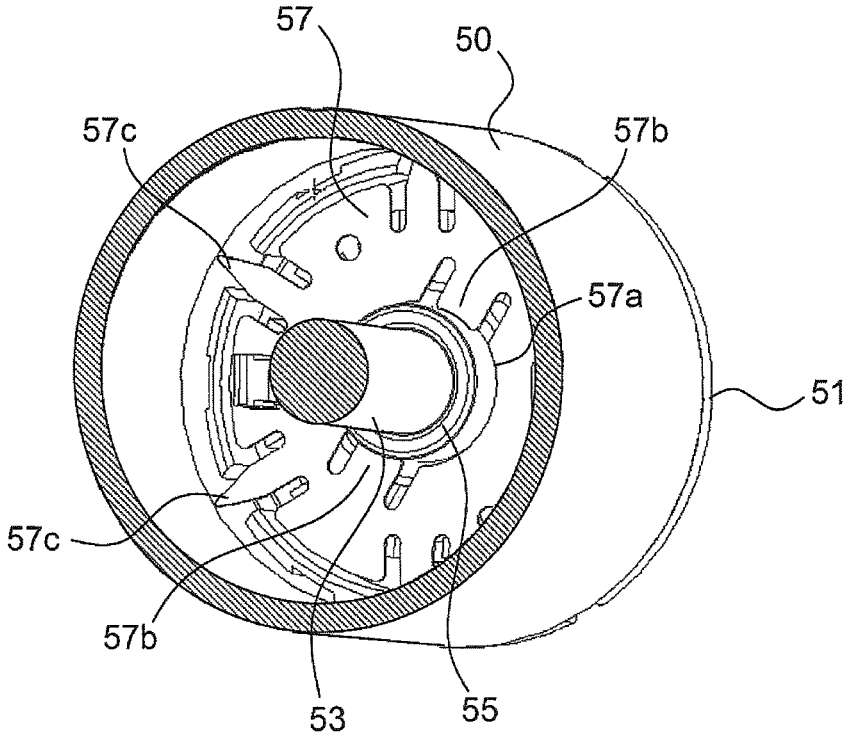
FIG. 9 is a sectional perspective view, as seen from the inside, of the photosensitive drum 1*a* as cut in the direction perpendicular to the drum shaft 53.

FIG. 4 is a side sectional view of one end (the front right side in FIG. 3) of the drum unit 40*a* as cut along the drum shaft 53. FIG. 5 is an enlarged perspective view of one end (the front right side in FIG. 3) of the drum unit 40*a*. FIG. 6 is a partial perspective view of one end of the photosensitive drum 1*a*. FIG. 7 is a partial perspective view of one end of the photosensitive drum 1*a* having a contact spring 60 fitted to the drum shaft 53. FIG. 8 is a perspective view of the contact spring 60. FIG. 9 is a sectional perspective view, as seen from the inside, of the photosensitive drum 1*a* as cut in the direction perpendicular to the drum shaft 53 (a sectional view along line A-A' in FIG. 4 as seen from the direction indicated by arrows A and A'). FIG. 5 shows a state with a drum main body 50 and a drum flange 51 removed to expose the drum shaft 53, an oil-impregnated sintered bearing 55, and a ground plate 57 arranged inside the photosensitive drum 1*a*.

The photosensitive drum 1*a* has a cylindrical drum main body 50, drum flanges 51 fitted to opposite end parts of the drum main body 50, a metal drum shaft 53 which supports the drum flanges 51 rotatably. The drum main body 50 is a drum pipe of aluminum laid with a photosensitive layer on its circumferential surface. As the photosensitive layer, for example, an organic photosensitive layer (OPC) formed of an organic photoconductor or an inorganic photosensitive layer such as an amorphous silicon photosensitive layer formed by vapor deposition using silane gas or the like is used.

The drum flanges 51 are disk-shaped members made of resin, and are, as shown in FIGS. 4 and 6, press-fixed in openings in the opposite end parts of the drum main body 50. At the center of each of the drum flanges 51, a through hole 51*a* is formed through which the drum shaft 53 penetrates.

In the through hole 51*a* in the drum flange 51, the oil-impregnated sintered bearing 55 is press-fixed. The oil-impregnated sintered bearing 55 is a plain bearing formed by compressing metal powder in a cylindrical shape, heating it at a temperature below the melting point (sintering), and impregnating it with lubricant oil. Inside the oil-impregnated sintered bearing 55, the drum shaft 53 is slidably inserted. The outer circumferential surface of the drum shaft 53 and the inner circumferential surface of the oil-impregnated sintered bearing 55 slide on each other, and thereby support the drum main body 50 and the drum flange 51 rotatably about the drum shaft 53.

Between the drum main body 50 and the oil-impregnated sintered bearing 55, the ground plate 57 which is made of metal is arranged. At the center of the ground plate 57, an engaging hole 57*a* is formed inside which the oil-impregnated sintered bearing 55 is inserted. At the inner circumferential rim of the engaging hole 57*a*, a pair of first protruding portions 57*b* is formed which makes contact with the outer circumferential surface of the oil-impregnated sintered bearing 55. At the outer circumferential rim of the ground plate 57, a plurality of second protruding portions 57*c* are formed which make contact with the inner circumferential surface of the drum main body 50. The ground plate 57 rotates together with the drum main body 50 and the oil-impregnated sintered bearing 55 while in contact with them.

The drum shaft 53 and the oil-impregnated sintered bearing 55 are both made of metal, and are in contact with each other at their sliding plane. However, as mentioned previously, oil exudes on the sliding plane of the oil-impregnated sintered bearing 55, and thereby forms an electrically insulating oil film. As a result, electrical conduction between the drum shaft 53 and the oil-impregnated sintered bearing 55 is blocked, and this makes the grounding (earthing) state of the photosensitive drum 1*a*unstable.

Thus, in this embodiment, as shown in FIG. 4, the contact spring 60 is fitted to a part of the drum shaft 53 between the oil-impregnated sintered bearing 55 and the unit housing 41. The contact spring 60 is formed of a metal wire member (spring member) having elasticity. As shown in FIG. 8, the contact spring 60 has a helical spring portion 60*a* in which the drum shaft 53 is inserted, a first extending portion 60*b* formed by extending an oil-impregnated sintered bearing 55-side end part of the helical spring portion 60*a* in a direction tangential to the helical spring portion 60*a*, and a second extending portion 60*c* formed by extending a unit housing 41-side end part of the helical spring portion 60*a* in the direction tangential to the helical spring portion 60*a*.

In the unit housing 41-side end part of the helical spring portion 60*a*, there is formed a one-turn contact portion 61 whose inner diameter is smaller than the outer diameter of the drum shaft 53. The inner diameter of the helical spring portion 60*a* except for the contact portion 61 is larger than the outer diameter of the drum shaft 53. The direction in which the helical spring portion 60*a* spirals is the same as the rotation direction of the drum main body 50 (the clockwise direction in FIG. 7) as seen from the unit housing 41 side (the front right side in FIG. 7).

The first extending portion 60*b* extends outward beyond the oil-impregnated sintered bearing 55 in a radial direction. The second extending portion 60*c* engages with an engaging portion (unillustrated) formed on the unit housing 41, and thereby prevents the contact spring 60 from being rotated together with the drum main body 50 and the drum flange 51.

When the photosensitive drum 1*a* is mounted in the drum unit 40*a*, first, the helical spring portion 60*a* of the contact spring 60 is fitted around the drum shaft 53 from the first extending portion 60*b* side (the opposite side from the contact portion 61). Here, the contact portion 61 is expanded from the inside by the drum shaft 53, and makes strong contact with the outer circumferential surface of the drum shaft 53. Then, the drum shaft 53 is inserted into a bearing hole 41*a* in the unit housing 41. Here, a concavity 53*a* formed in the outer circumferential surface of the drum shaft 53 engages with a convexity 42 provided in the bearing hole 41*a*, and thereby restricts the rotation of the rotary shaft 53.

Although no illustration is given here, also in a drum flange 51 at the other end (the rear left side in FIG. 3) of the photosensitive drum 1*a*, an oil-impregnated sintered bearing 55 is press-fixed. Then, a driving force is transmitted from a drive output coupling (unillustrated) to a drive input coupling (unillustrated) formed on the drum flange 51 at the other end, and thereby the drum main body 50 and the drum flange 51 rotate together about the drum shaft 53.

The contact spring 60 fitted around the drum shaft 53 is held in a compressed state with one and the other ends of the helical spring portion 60*a* in contact with the oil-impregnated sintered bearing 55 and the unit housing 41 respectively. One end of the helical spring portion 60*a* makes contact with an end surface of the oil-impregnated sintered bearing 55 in the axial direction, and the contact portion 61 makes contact with the outer circumferential surface of the drum shaft 53; this keeps the oil-impregnated sintered bearing 55 and the drum shaft 53 in mutual electrical conduction.

As shown in FIGS. 4 and 9, the first protruding portions 57*b* of the ground plate 57 make contact with the outer circumferential surface of the oil-impregnated sintered bearing 55, and the second protruding portions 57*c* of the ground plate 57 make contact with the inner circumferential surface of the drum main body 50. This keeps the drum main body 50 and the oil-impregnated sintered bearing 55 in mutual electrical conduction. That is, via the ground plate 57, the oil-impregnated sintered bearing 55, and the contact spring 60, mutual electrical conduction is achieved between the drum main body 50 and the drum shaft 53.

Then, a tip end of the drum shaft 53 fits on a bearing portion 63*a* (see FIG. 4) formed on an image forming apparatus 100 main body-side frame 63. Over the bearing portion 63*a*, a pressure spring 65 is arranged, and the drum shaft 53 is held on the bearing portion 63*a* by being biased downward by the pressure spring 65. Thereby, the photosensitive drum 1*a* is positioned at a predetermined position in the main body of the image forming apparatus 100. The drum shaft 53 makes contact with the frame 63, and thereby the photosensitive drum 1*a* is grounded via the frame 63.

With the configuration according to this embodiment, the drum shaft 53 and the oil-impregnated sintered bearing 55 are electrically connected together via the contact spring 60, and thus, their contact pressure is stabilized by the biasing force of the contact spring 60 (a spring load). As a result, the conductive resistance value at a place where the oil-impregnated sintered bearing 55 and the contact spring 60 make contact with each other is stabilized at a low value. Although, on the sliding plane (inner circumferential surface) of the oil-impregnated sintered bearing 55, an oil film is formed, the contact spring 60 makes contact with an end surface of the oil-impregnated sintered bearing 55 in the axial direction, and thus can keep stable electrical conduction without being affected by the oil film. Thus, it is possible to effectively suppress image unevenness resulting from electric charge remaining on the surface of the photosensitive drum 1*a*.

Of the contact spring 60, only the contact portion 61 of the helical spring portion 60*a* makes contact with the outer circumferential surface of the drum shaft 53; this helps reduce the friction resistance between the drum shaft 53 and the contact spring 60. Thus, it is possible to suppress an increase in the rotation load of the drum main body 50 and the drum flange 51 caused by mounting the contact spring 60.

The direction in which the helical spring portion 60*a* spirals as seen from the unit housing 41 side (the second extending portion 60*c* side) is the same as the rotation direction of the drum main body 50, and thus, in a place where the helical spring portion 60*a* and the oil-impregnated sintered bearing 55 make contact with each other and in a place where the contact portion 61 and the drum shaft 53 make contact with each other, no load is applied in the direction in which the helical shape of the helical spring portion 60*a* loosens. Thus, it is possible to stabilize the contact state between the contact portion 61 and the drum shaft 53.

As shown in FIG. 7, the first extending portion 60*b* of the contact spring 60 extends outward beyond the oil-impregnated sintered bearing 55 in a radial direction, and thus a tip end of the first extending portion 60*b* does not make contact with an end surface of the oil-impregnated sintered bearing 55 in the axial direction. Thus, there is no danger of the end surface of the oil-impregnated sintered bearing 55 being rubbed by the top end of the metal wire member that forms the contact spring 60, and it is thus possible to suppress scratches on the end surface of the oil-impregnated sintered bearing 55 and an increase in the rotation load.

The embodiments described above are in no way meant to limit the present invention, which thus allows for many modifications and variations within the spirit of the present invention. For example, although in the above-described embodiment, the ground plate 57 is used to achieve mutual electrical conduction between the drum main body 50 and the oil-impregnated sintered bearing 55, instead of the ground plate 57, for example, a ground wire may be used to achieve mutual electrical conduction between the drum main body 50 and the oil-impregnated sintered bearing 55.

Although in the above-described embodiment, in the contact spring 60, the first extending portion 60*b*, the second extending portion 60*c*, and the contact portion 61 are formed, this is merely an example of a preferable configuration and is not an essential configuration.

The present invention is applicable, not only to color printers like the one shown in FIG. 1, but also to other image forming apparatuses such as monochrome printers, monochrome and color copiers, and digital multifunction peripherals (having the functions of a copier, a facsimile machine, a scanner, and the like integrated together, also known as MFPs (multifunction peripherals)).

INDUSTRIAL APPLICABILITY

The prevent invention is applicable to an image carrying member unit mounted in an image forming apparatus. Based on the present invention, it is possible to provide an image carrying member unit and an image forming apparatus that can stabilize the conductive resistance between an image carrying member main body and a support shaft even when the amount of impregnated oil of an oil-impregnated sintered bearing interposed between the image carrying member main body and the support shaft varies or the load applied to the bearing varies.

The invention claimed is:

1. An image carrying member unit comprising:

an image carrying member on which an electrostatic latent image is formed; and a unit housing which holds the image carrying member, wherein the image carrying member includes:

an image carrying member main body on a circumferential surface of which a photosensitive layer is formed;

flange portions fixed to opposite end parts of the image carrying member main body, the flange portions each having formed therein a through hole at a center of rotation of the image carrying member main body;

a cylindrical oil-impregnated sintered bearing fixed in the through hole in each of the flange portions;

a conductive member through which mutual electrical conduction is achieved between the oil-impregnated sintered bearing and the image carrying member main body;

a support shaft slidably inserted into the oil-impregnated sintered bearing to be fixed to the unit housing; and a contact spring having a helical spring portion into which the support shaft is inserted, the contact spring permitting mutual electrical conduction between the oil-impregnated sintered bearing and the support shaft by being held in a compressed state between an end surface of the oil-impregnated sintered bearing in an axial direction and the unit housing, wherein the contact spring has a first extending portion formed by extending an oil-impregnated sintered bearing-side end part of the helical spring portion in a direction tangential to the helical spring portion outward beyond the oil-impregnated sintered bearing in a radial direction.

2. The image carrying member unit of the claim 1, wherein in a unit housing-side end part of the helical spring portion, a one-turn contact portion is formed whose inner diameter is smaller than an outer diameter of the support shaft, and an inner diameter of the helical spring portion except for the contact portion is larger than the outer diameter of the support shaft.

3. The image carrying member unit of claim 1, wherein the contact spring has a second extending portion formed by extending a unit housing-side end part of the helical spring portion in the direction tangential to the helical spring portion, the second extending portion engaging with the unit housing.

4. The image carrying member unit of claim 3, wherein a direction in which the helical spring portion spirals coincides with a direction in which the image carrying member main body rotates as seen from a second extending portion side.

5. An image forming apparatus comprising the image carrying member unit of claim 1.

* * * * *